United States Patent [19]

Ledford et al.

[11] Patent Number: 4,484,559

[45] Date of Patent: Nov. 27, 1984

[54] APPARATUS FOR REMOVING MATERIAL SUCH AS CONCRETE FROM UNDERWATER PIPELINES

[75] Inventors: Billy R. Ledford, Huldenberg; Alan J. Hartt, Kalmphout, both of Belgium

[73] Assignee: McDermott Incorporated, New Orleans, La.

[21] Appl. No.: 353,749

[22] Filed: Mar. 1, 1982

[51] Int. Cl.[3] ..... B28D 1/00

[52] U.S. Cl. ..... 125/1; 29/426.4; 83/875; 83/924; 125/23 R

[58] Field of Search ..... 125/1, 23, 14; 29/426.4; 30/92.5; 83/875, 924; 81/9.51; 144/136.14

[56] References Cited

U.S. PATENT DOCUMENTS

| | | | |
|---|---|---|---|
| 1,629,696 | 5/1927 | Goff | 30/92.5 |
| 3,176,550 | 4/1965 | Marcotte | 81/9.51 |
| 4,044,749 | 8/1977 | Bowen | 125/23 R |
| 4,318,391 | 3/1982 | Wachs | 125/14 |

*Primary Examiner*—Harold D. Whitehead

*Attorney, Agent, or Firm*—Robert J. Edwards; James C. Simmons

[57] ABSTRACT

Apparatus for removing covering material from underwater pipelines. A frame of the apparatus is clampingly engaged to the pipeline. A plurality of pipeline material cutters are cantileverly supported beyond the clamp to provide a plurality of cutting passes simultaneously and away from the points of attachment of the apparatus to a pipeline.

10 Claims, 7 Drawing Figures

APPARATUS FOR REMOVING MATERIAL SUCH AS CONCRETE FROM UNDERWATER PIPELINES

This invention relates generally to pipeline cleaning. More particularly, this invention relates to the removal of covering material such as reinforced concrete and the like from the exterior surface of all or a portion of an underwater pipeline.

Along with the presently ever increasing requirements for off-shore oil and gas production come the equally increasing requirements for the laying of underwater pipelines for the purposes of transporting such fluids. It is usually necessary to coat such pipeline with a heavy external coating of concrete or the like in order to cause the pipeline to remain in a submerged location rather than floating to the surface. Such a coating is also often reinforced with wire, re-bars, and the like. Often the concrete covered pipelines become damaged for one reason or another, either through natural forces acting on the pipe or through accidents such as anchor damage by vessels utilizing the water space above the pipe. In carrying out repairs to the pipeline after such damage, it is usually necessary to remove the concrete covering material from a portion of the pipeline.

Unlike repair procedures carried out on dry land, pipeline repairs including concrete removal under water have been very difficult and have usually been made by divers decending to the level of the submerged pipe and using such tools as a sledge hammer and chisel, hand-held underwater saws or chipping hammers, explosives in some cases, and hand-held high pressure water blasters. Each of these methods is inadequate for one or more reasons. Some are unacceptable for safety reasons. Others are unacceptable because they can not complete the task within desired specifications. Others are time consuming and inefficient.

It is desirable that diving work involving pipeline repair including the removal of concrete from underwater pipelines be completed as quickly as possible. When diving work is being done, an entire barge with a 80 to 200 man crew is often being paid for while the only productive work being done is that of one or two divers. In addition, in the North Sea and other locations which have severe weather conditions, productive work may be possible only during 20% or less of the time a barge is being used. When diving facilities, tugboats, supply boats, and all other support costs are included, operation of a barge will typically cost in the range of 100,000 to 200,000 dollars per day. Taking into consideration that less than 20% of the time during which a barge is being used may be productive time, it is easily seen that even an hour's savings in removal of reinforced concrete covering from underwater pipelines may be worth as much as 40,000 dollars. Therefore, it is very desirable in the off-shore oil and gas industry to provide equipment for such work which is safe, efficient, and saves time.

In many instances it may be necessary to remove the concrete from a very lengthy portion of underwater pipeline such as 10 feet thereof. For example, it may be desirable to surroundingly engage a lengthy portion of concrete removed pipeline with a large bell-type structure to provide workmen with a dry habitat in which to carry out a repair operation. In order to first remove the concrete covering from the pipeline portion, it may be required that a concrete removal apparatus be securely attached to the pipeline for a predetermined cutting pass of perhaps four feet and then be securely attached to the pipeline at one or more successive locations along the pipeline for additional predetermined cutting passes until the concrete along the entire portion of pipeline has been cut. If an apparatus were attached on one side of the location of a desired cutting pass to a portion of pipeline from which the concrete had been removed and were attached on the other side to a portion of pipeline from which the concrete had not been removed, the difference in diameter between the two sides may cause mis-alignment of the apparatus on the pipeline and may thereby make the undesired cutting of the pipeline portion during a cutting pass more likely.

It is, therefore, an object of the present invention to provide an apparatus which will quickly and safely remove covering material such as reinforced concrete from underwater pipelines.

It is also an object of the present invention to provide such an apparatus which may be successively securely attached and aligned to a concrete covered pipeline for correspondingly accurate successive cutting passes.

It is a further object of the present invention to provide such an apparatus wherein the entire apparatus is easily movable along a pipeline between successive cutting passes.

The above and other objects, features, and advantages of this invention will be apparent in the following detailed description of the preferred embodiments thereof which is to be read in connection with the accompanying drawings;

Figure 1:
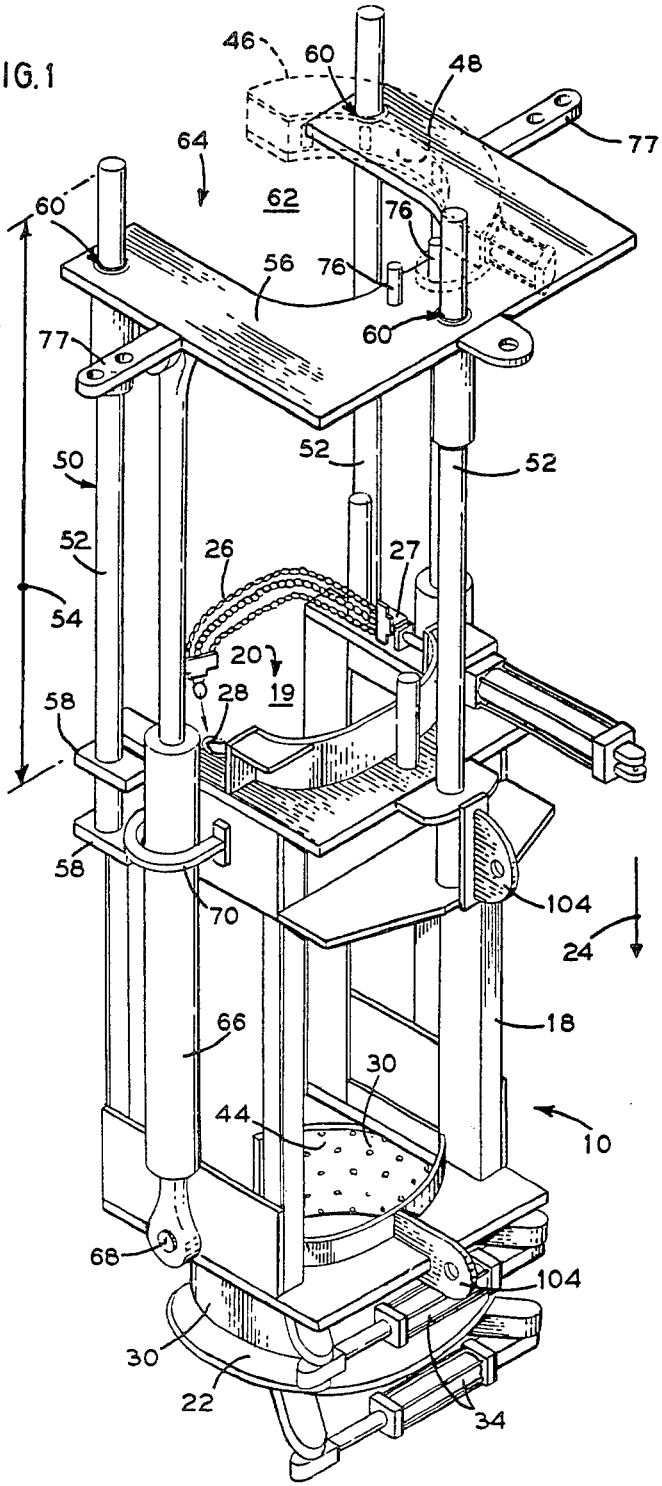
FIG. 1 is a perspective view of an apparatus embodying this invention.
Figure 2:
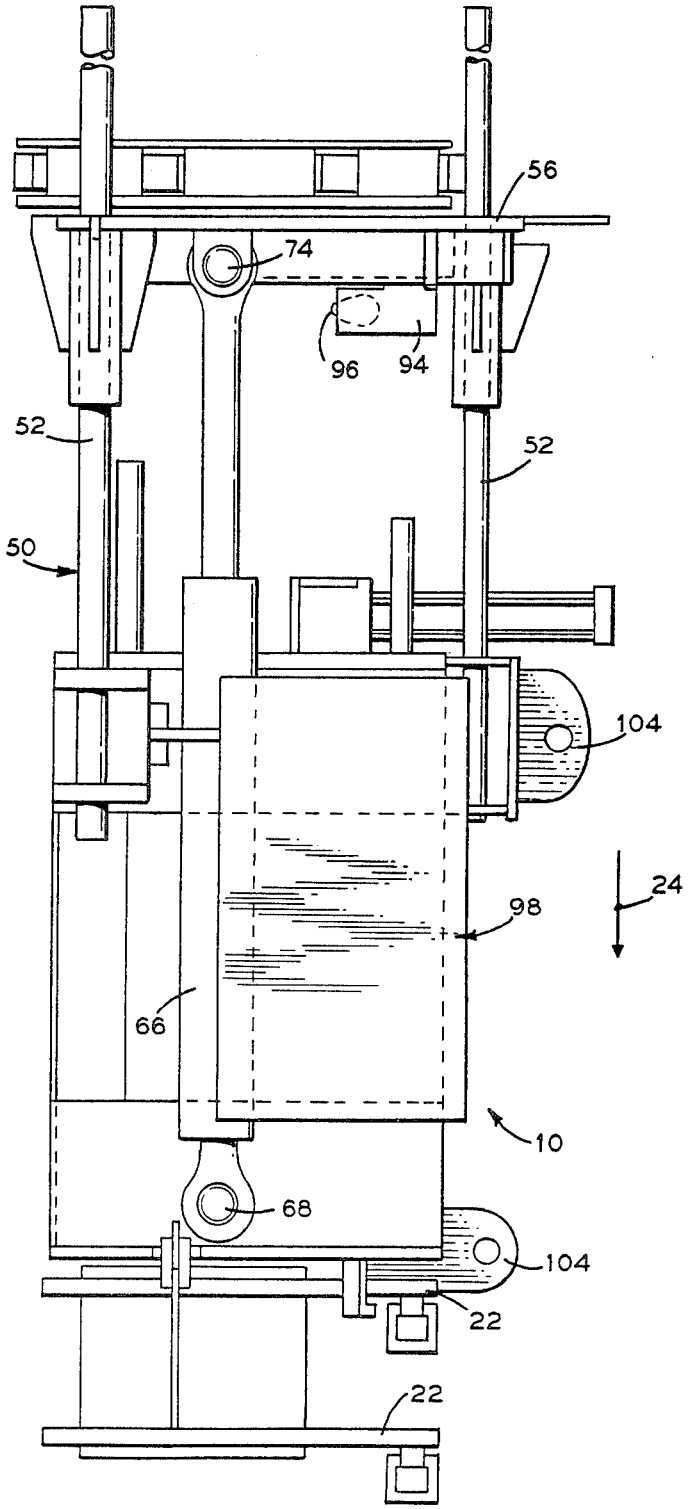
FIG. 2 is a plan view thereof.

Referring now to FIG. 1, there is shown an apparatus 10 for removing covering material from underwater pipelines. A typical underwater pipeline section for which this apparatus may be used is illustrated at 12 in FIGS. 3 and 4 and is composed of 20 inch pipe which is surrounded by pipe-protecting mastik 14 of a thickness of perhaps 3/16 inch and reinforced concrete 16 of a thickness of perhaps 2 inches. The frame 18 of the apparatus 10 is shaped or fabricated to define over the length thereof a central space illustrated at 19 to permit the frame 18 to generally enclose a pipeline portion within the space 19. An opening illustrated at 20 is preferably provided to the central space along the length thereof to permit implacement of the frame 18 about the pipeline 12.

Figure 3:
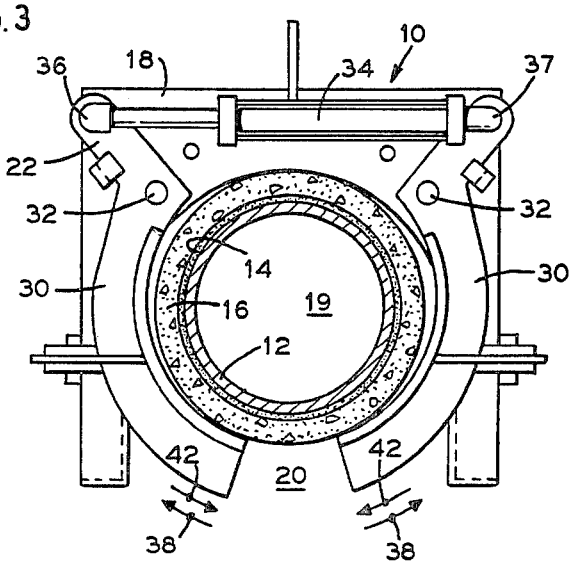
FIG. 3 is a view of one end thereof.

The apparatus 10 is also provided with means for clamping the frame 18 to the pipeline 12 so that it can be held rigidly to provide support for a cutting operation to be performed to the covering material of an adjacent portion of the pipeline 12. Although such clamping means may take many forms, the clamping means of this invention preferably comprises one or more such as a pair of hydraulically actuated clamps 22 located at one end of the frame 18. Spaced apart in the longitudinal direction 24 of the apparatus 10 from clamps 22 and located at the opposite end of the frame 18 is preferably a chain or chains 26 attached to member 27 for passing under a pipeline 12 and securing to eye 28 in the frame structure 18. For the purposes of this invention, a longitudinal direction of the apparatus 10 is defined as a direction parallel to the longitudinal axis of a pipe upon which the apparatus is mounted. As shown in FIG. 3, each clamp 22 comprises a pair of arcuate members 30 which are provided with fulcrums at pins 32 and which are connected by hydraulic cylinder or ram 34 at pins 36 and 37 for movement in direction 42 to the position shown in FIG. 3 to clampingly engage a pipeline portion when force is applied by the hydraulic cylinders 34. Arcuate members 30 are also movable in direction 38 to disengage a pipeline and to permit mounting of the frame 18 about a pipeline portion. As shown in FIGS. 1 and 3, the inner surfaces 44 (that is, those surfaces which face a pipeline portion when the apparatus 10 is mounted thereon) of these arcuate members 30 are shaped to conform generally to an arc of the circumference of a pipeline. The surfaces 44 of the arcuate members 30 are preferably studded for improved frictional contact.

Figure 4:
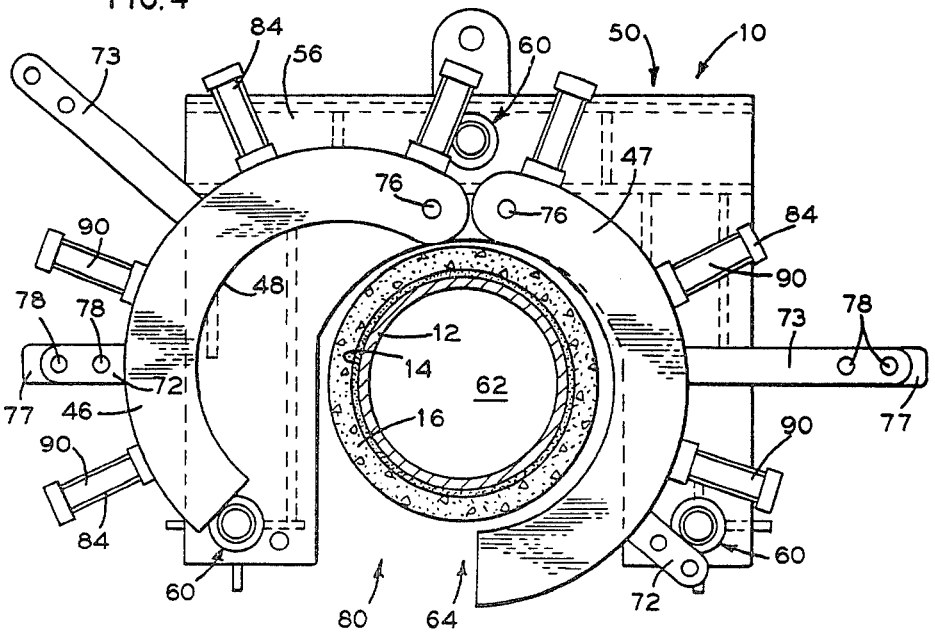
FIG. 4 is a view of the other end thereof.

The apparatus 10 is also provided with carriage means for effecting movement of at least one but preferably a pair of members 46 and 47 longitudinally of the apparatus 10 for movement along pipeline 12 with a surface 48 of each member 46 and 47 adjacent to but preferably not in contact with the pipeline covering material 16 to be cut. To provide greater clarity in FIG. 1, member 47 is not shown and a phantom view of member 46 is shown to illustrate its position on the apparatus. Members 46 and 47 are best shown in FIG. 4. Refering again to FIG. 1, the carriage means, illustrated generally at 50, is provided with at least one rigid guide member 52. However, in order to insure accurate positioning of the members 46 and 47 relative to a pipeline portion for a cutting pass, the carriage means 50 is provided with preferably three or more rigid guide members 52. These guide members 52 are rigidly attached to the frame 18 at points 58 and extend longitudinally of the apparatus 10 beyond the clamp means a distance illustrated generally at 54 to act as cantilevers for support of plate 56 away from the clamp means or other points of attachment of the apparatus 10 to the pipeline so that the apparatus 10 may be securely mounted on the pipeline 12 only on one side of the pipeline portion thereof upon which cutting is to be performed to thereby avoid mis-alignment of the apparatus 10 on a pipeline portion and to simplify mounting of the apparatus on a pipeline. The plate 56 is slidably engaged to guide members 52 at apertures 60 for movement in a longitudinal direction 24 along the guide members 52. The plate 56 is generally horse-shoe shaped to define a central space illustrated at 62 corresponding to frame central space 19 and an opening illustrated at 64 correspondngly to frame opening 20 for mounting of the apparatus 10 onto the pipeline 12. An hydrualic cylinder or ram 66, which is attached to the frame 18 at pin 68 and by clamp 70 and which is attached to the plate 56 at pin 74, effects movement of the plate 56 longitudinally along the guide members 52.

Members 46 and 47 are attached to the plate 56 by means of pins 76. These members 46 and 47 are pivotably movable at pins 76 to the position illustrated by member 46 in FIG. 4 and locked at that position by attaching extensions 72 thereof to plate portions 77 utilizing appropriate fastening means at 78 to provide an opening illustrated at 80, corresponding to openings 20 and 64, for mounting of the apparatus 10 onto the pipeline 12. These members 46 and 47 are movable to the position illustrated by member 47 in FIG. 4 and secured in that position by attaching extensions 73 thereof to plate portions 77 utilizing appropriate fastening means at 78 to dispose surfaces 48 adjacent the pipeline covering material 16 for a cutting pass of a portion of the material covered pipeline as will be hereinafter explained. Surfaces 48 are advanced longitudinally along and maintained adjacent the pipeline covering material 16 during a cutting pass as the hydraulic cylinder 66 effects movement of the plate 56 longitudinally along the guide members 52. Therefore, these surfaces 48 are preferably arc-shaped to conform to an arc of the circumference of a material covered pipe 12 so that together these surfaces 48 may be disposed adjacent the material covering 16 of the pipe 12 over a substantial portion such as 270 degrees of the circumference thereof.

Figure 5:
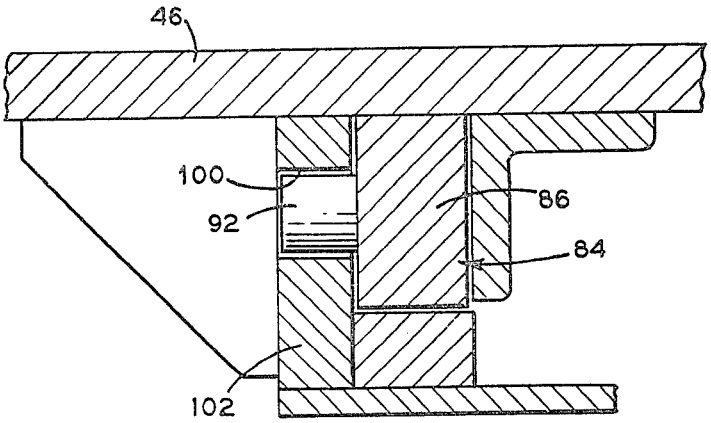
FIG. 5 is a partial enlarged section view of a cutting means thereof.
Figure 6:
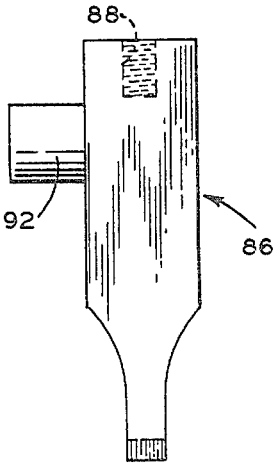
FIG. 6 is an enlarged front view of a cutter blade thereof.
Figure 7:
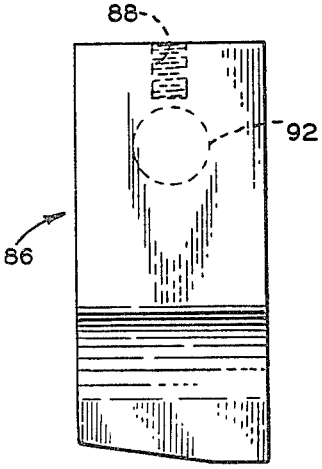
FIG. 7 is an enlarged side view of the cutter blade of FIG. 6.

At least one cutting means 84 is mounted in or on each member 46 and 47. Referring to FIGS. 5, 6, and 7, cutting means 84 includes a blade 86 which is preferably retractable into the body of the respective members 46 and 47 and which is extendible at least partially past the respective member surface 48 for contact with the pipeline covering material 16 for cutting thereof. In order to provide an increased speed of removal of pipeline covering material along a portion of a pipeline in accordance with an aspect of this invention, a plurality such as eight of such cutting means 84 are provided on the members 46 and 47 and positioned to be spaced apart about the circumference of a pipeline 12 when the apparatus 10 is mounted thereon as shown in FIG. 4 for cutting of the pipeline covering material 16 at a plurality such as eight locations about the circumference of a pipeline 12 simultaneously.

Referring to FIG. 6, cutting blade 86 is preferably attached by means of a threaded aperture 88 to a piston of an hydraulic cylinder or ram 90 (See FIG. 4) for urging the blade 86 into engagement with covering material of a pipeline for cutting thereof. For example, hydrualic cylinders 90 may have a capacity of five tons at 10,000 psi for pushing the cutter blades $\frac{3}{8}$ inch into a concrete covering. A control panel illustrated at 98 may be provided to permit local control by a diver of selected functions such as operation of the cutting means 84.

A means for preventing penetration of the cutting blade 86 beyond a predetermined distance past the respective surface 48 may be provided to control depth of penetration of the cutter blades 86 into pipeline covering material and such means may include stop member 92 movable in slot 100 of guide plate 102.

In accordance with a preferred embodiment of this invention, at least one but preferably two roller guides 94 attached to plate 56 are provided. These roller guides 94 are adjustable in the radial direction of a pipeline 12 upon which the apparatus 10 is mounted and have nylon rollers 96 which rest on the top surface of the material covered pipeline 12 to provide positive alignment of the plate 56 and cutting means 84 and to further insure that a pipeline wall is not cut. Each of these roller guides 94 is spaced preferably approximately 15 to 20 degrees from the vertical centerline of the pipeline 12.

Eye members 104 may be provided for attachment of the apparatus 10 to lines for lowering it to a pipeline 12 for mounting thereon. After the apparatus 10 is lowered to a pipeline 12, it is mounted on the pipeline to surroundingly engage it so that a pipeline portion is disposed within central space 19. Access of a pipeline portion 12 to central space 19 is provided by leaving chain 26 unattached to the eye 28, the clamps 22 in the open position, and cutting members 46 and 47 in the position shown by member 46 in FIG. 4. The apparatus 10 is then securely clamped to the pipeline 12 by hydraulically clamping it at clamps 22, and securely fastening the chain at eye 28 after passing it tightly around the lower part of the pipeline 12. Members 46 and 47 are positioned with surfaces 48 adjacent the covering material 16 of the pipeline. Hydraulic force is then applied to the cutting means 84 by cylinders 90 to push the respective cutter blades 86 a predetermined distance into the covering material 16. Pressure is applied to hydraulic cylinder 66 to effect movement of plate 56 longitudinally along the pipeline 12. Plate 56 carries members 46 and 47 and their cutting means 84 longitudinally along the material covered pipeline 12 to effect cuts in the covering material 16. The scope of this invention is meant to include the effecting of a cutting pass either during movement of the plate 56 toward or during movement of the plate 56 away from the points of attachment of the apparatus to a pipeline. If one pass is of insufficient depth to cut the covering material 16 sufficiently, two or more passes may be required with the cutter blades 86 being pushed a greater distance into the covering material 16 with each pass until which time the covering material is sufficiently cut. At this time, hand tools may be used to simply and easily remove the cut segments of reinforced concrete from the pipeline 12. A typical operation of this type with several cutting means 84 performing a cutting operation simultaneously may require only half as much time as conventional concrete removal means require.

If the length of pipeline covering material 16 to be removed is longer than the length of a cutting pass, then after a first segment of the covering material is cut, the apparatus may then be unclamped and moved to the next successive location further along the pipeline so that additional cutting operations may be performed without the misalignment that may otherwise result if a portion of the apparatus were clamped to a portion of a pipeline covered with concrete and another portion of the apparatus were clamped to a portion of the pipeline from which the concrete had been removed. In order to more easily move the apparatus 10 to the next successive location along the pipeline, the cutting means 84, since it is cantileverly supported away from the remainder of the apparatus, may be allowed to grippingly engage and thus become anchored in the pipeline covering while hydraulic cylinder 66 is extended thereby resulting in the apparatus "walking" down the pipeline. The apparatus may then be reclamped to the pipeline for another cutting pass.

Certain features of this invention may sometimes be used to advantage without a corresponding use of the other features. It is also to be understood that the invention is by no means limited to the specific embodiments which have been illustrated and described herein, and that various modifications may indeed be made within the scope of the present invention as defined by the appended claims.

What is claimed is:

1. Apparatus for removing covering material from underwater pipelines, the apparatus comprising a. a frame;

b. means for clamping said frame to a material covered underwater pipeline;

c. at least one member having an arcuate surface for positioning a plurality of cutting means in spaced relation circumferentially about the material covered pipeline;

d. carriage means attached to said frame for effecting movement of said member in a direction along the pipeline with said arcuate surface adjacent the pipeline covering material; and e. a plurality of cutting means attached to said member and spaced apart in a direction of curvature of said arcuate surface for cutting the pipeline covering material at a plurality of points spaced-apart circumferentially of the pipeline simultaneously, said carriage means including at least one guide member rigidly attached to said frame and extending beyond said clamp means to act as a cantilever for support of said cutting means away from the points of attachment of the apparatus to a pipeline.

2. Apparatus for removing covering material from underwater pipelines, the apparatus comprising:

a. a frame;

b. means for clamping said frame to a material covered underwater pipeline;

c. at least one cutting means; and d. carriage means attached to said frame for effecting movement of said cutting means in a direction along the pipeline for cutting of pipeline covering material, said carriage means including at least one guide member rigidly attached to said frame and extending beyond said clamp means to act as a cantilever for support of said cutting means away from the points of attachment of the apparatus to a pipeline.

3. Apparatus according to claim 2 further comprising at least one member having an arcuate surface for positioning a plurality of said cutting means in spaced relation circumferentially about the material covered pipeline, and a plurality of said cutting means attached to said member and spaced apart in a direction of curvature of said arcuate surface for cutting the pipeline covering material simultaneously at a plurality of points spaced-apart circumferentially of the pipeline with said arcuate surface adjacent the pipeline covering material.

4. Apparatus according to any one of claims 1 and 3 wherein the apparatus comprises a pair of members to which said cutting means are attached which member arcuate surfaces together conform substantially to the circumference of the material covered pipeline for positioning said cutting means in spaced relation substantially entirely about the pipeline circumference.

5. Apparatus according to any one of claims 1 and 3 wherein said cutting means includes a blade extendible at least partially beyond said arcuate surface and hydraulic means for forcing said cutting blade from a retracted position in said member at least partially beyond said arcuate surface, said cutting means further including means for limiting movement of said cutting blade to a predetermined distance beyond said surface.

6. Apparatus according to any one of claims 2 and 3 wherein said carriage means further includes a plate mounted on said guide member for carriage of said cutting means in a direction along the pipeline, and at least one hydraulic means for effecting movement of said plate along said guide member.

7. Apparatus according to claim 6 further comprising at least one adjustable roller guide means for maintaining a position of said plate relative to the material covered pipeline during carriage along said guide member.

8. Apparatus according to claim 6 wherein said clamp means includes first and second clamp means which are spaced apart in a longitudinal direction of the apparatus, said first clamp means comprises a pair of arcuate members each of which has a surface which conforms substantially to an outer surface of the material covered pipeline, and said first clamp means further comprises hydraulic means for applying pressure to said arcuate members for at least partially surrounding and clamping engagement of the pipeline.

9. Apparatus according to claim 8 wherein the apparatus comprises a pair of members to which said cutting means are attached which members have arcuate surfaces which together conform substantially to the circumference of the material covered pipeline for positioning said cutting means in spaced relation substantially entirely about the pipeline circumference.

10. Apparatus according to any one of claims 1 and 3 wherein said frame defines a central space and an opening to said central space for at least partial surrounding engagement of a portion of the pipeline by the apparatus, said clamp means including first and second clamp means at least one of which comprises a pair of arcuate members, said arcuate members and said member to which said cutting means are attached each being pivotably adjustable to define openings which together with said frame opening provide an opening to said central space along the entire length of the apparatus for mounting of the apparatus on a material covered pipeline.

* * * * *